US008091161B1

(12) United States Patent
Schulz, Jr. et al.

(10) Patent No.: US 8,091,161 B1
(45) Date of Patent: Jan. 10, 2012

(54) VARIABLE SPRING SURFACE DECK AND FOUNDATION HAVING VARIABLE SPRING SURFACE DECK

(76) Inventors: Martin Schulz, Jr., Brenham, TX (US); Martin Schulz, III, Hempstead, TX (US)

( * ) Notice: Subject to any disclaimer, the term of this patent is extended or adjusted under 35 U.S.C. 154(b) by 288 days.

(21) Appl. No.: 12/548,551

(22) Filed: Aug. 27, 2009

(51) Int. Cl.
*A47C 23/00* (2006.01)

(52) U.S. Cl. ..... 5/186.1; 5/400; 5/924

(58) Field of Classification Search ..... 5/186.1, 5/191, 189, 190, 400, 924; 248/346.4
See application file for complete search history.

(56) References Cited

U.S. PATENT DOCUMENTS 3,838,469 A * 10/1974 Rademaker ..... 5/191
3,913,154 A * 10/1975 Sweeney ..... 5/186.1
4,074,372 A * 2/1978 Schulz, Jr. ..... 5/263
4,112,529 A * 9/1978 Golembeck et al. ..... 5/401
4,181,991 A * 1/1980 Morgan et al. ..... 5/400
4,377,279 A * 3/1983 Schulz et al. ..... 267/103
5,701,653 A * 12/1997 Rupe ..... 29/432

* cited by examiner

*Primary Examiner* — Michael Trettel
(74) *Attorney, Agent, or Firm* — Barnes & Thornburg LLP

(57) ABSTRACT

A variable spring surface deck and a foundation having a variable spring surface deck thereon. The deck comprises a plurality of longitudinal spring wire support rods which are maintained in a spaced orientation in a planar configuration. They are maintained as such in various structures, such as a mat having a series of parallel slots, or a carrier having spaced, open corrugations. The support rods are located in chosen slots or corrugations. A second, cross-wire layer of lateral spring wire support rods can be included in the variable spring surface deck. The variable spring surface foundation includes the variable spring surface deck located on a top bearing structure of a foundation unit.

14 Claims, 4 Drawing Sheets

VARIABLE SPRING SURFACE DECK AND FOUNDATION HAVING VARIABLE SPRING SURFACE DECK

BACKGROUND OF THE INVENTION

This invention relates to foundation units, and more particularly to a variable spring surface deck for a foundation, as well as a foundation having such a deck. The deck allows for spacial variation of and various amounts of spring support for the foundation.

Foundation units are found in many forms. The typical "box spring" is composed of a flat wooden bottom frame, a grid wire top surface, and a series of transverse rows and longitudinal columns of coil springs attached between the grid wire and the wooden frame. Top padding and a cover are then applied to give the foundation a finished look.

An alternative form of a box spring foundation is found in U.S. Pat. No. 4,074,372. In this patent, a wooden frame of substantially greater depth is employed, which increases the strength of the foundation and reduces the depth of the coil springs required. Similar to the typical "box spring", it is finished with padding and a cover.

Other, less expensive foundations are fabricated using only a wooden or rigid wire frame. A build up of one or more inches of padding material is used to cushion the top of the foundation unit, and a cover is applied in a usual fashion. One type of rigid wire frame foundation is disclosed in U.S. Pat. No. 4,377,279.

A substantial disadvantage of all prior art foundations is either difficulty or inability of varying the surface support of the foundation. As a result, many different models of the same or a similar foundation must be provided if varying support is desired.

SUMMARY OF THE INVENTION

The invention provides a variable spring surface deck for a foundation. The deck comprises a plurality of longitudinal, spring wire support rods, and means maintaining the support rods in a spaced orientation in a planar configuration.

In one form of the invention, the maintaining means comprises a mat having a series of parallel slots, with each slot being shaped to engage one of the support rods. In one version of this form of the invention, the rods are regularly spaced, and may be equally spaced.

In another form of the invention, the maintaining means comprises a carrier containing the rods. The carrier preferably comprises a corrugated sheet, with the sheet including spaced, open corrugations. The rods are located in at least some of the corrugations.

A variable spring surface foundation according to the invention comprises a foundation unit of determined depth and having a bottom substructure, a flat top bearing structure generally rectangular in shape, and an intermediate support for maintaining the determined depth. The variable spring surface deck is located on the top bearing structure.

BRIEF DESCRIPTION OF THE DRAWINGS

The invention is described in greater detail on the following description of examples embodying the best mode of the invention, taking in conjunction with the drawing figures, in which.

DESCRIPTION OF EXAMPLES EMBODYING THE BEST MODE OF THE INVENTION

Figure 1:
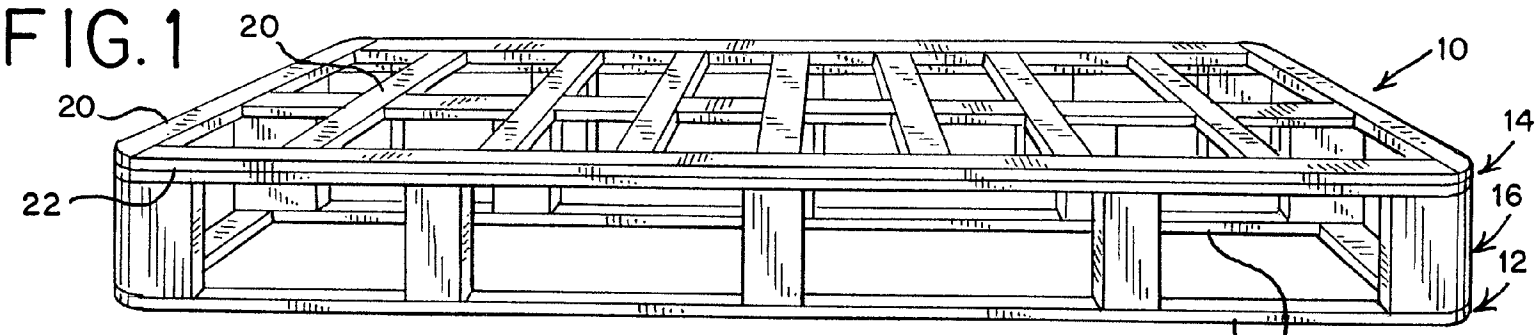
FIG. 1 is a perspective view of a foundation unit employed in a foundation according to the invention.
Figure 2:
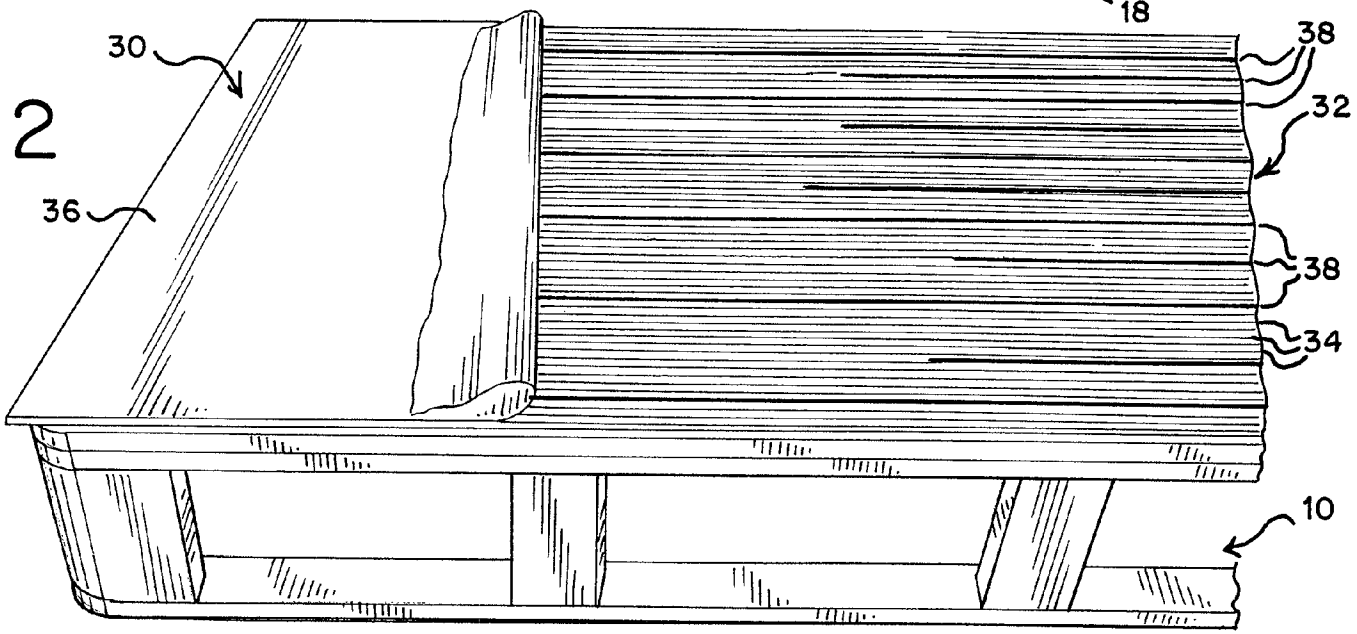
FIG. 2 is a perspective view of one form of variable spring surface deck according to the invention applied to the foundation unit of FIG. 1, with a layer removed to show detail.
Figure 3:
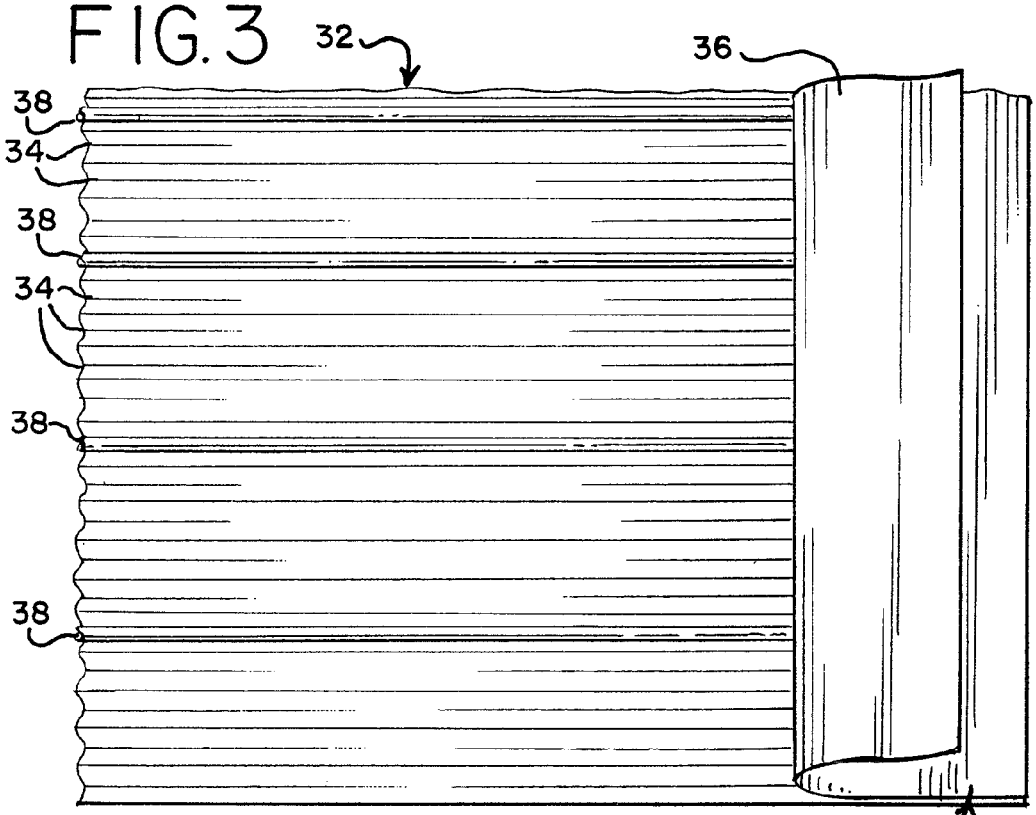
FIG. 3 is a greatly enlarged, close-up view of a variable spring surface deck according to the invention, showing varying spacing of spring wire support rods.
Figure 4:
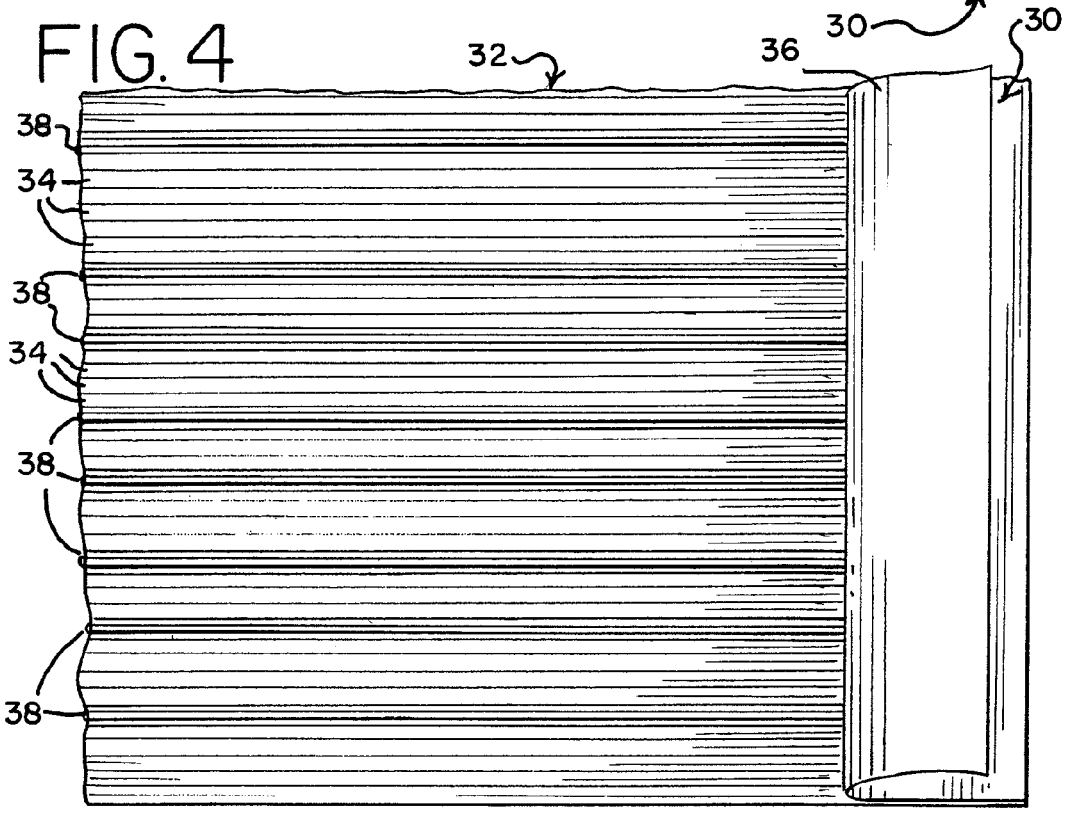
FIG. 4 is a view similar to FIG. 3, but taken from a somewhat greater distance.
Figure 5:
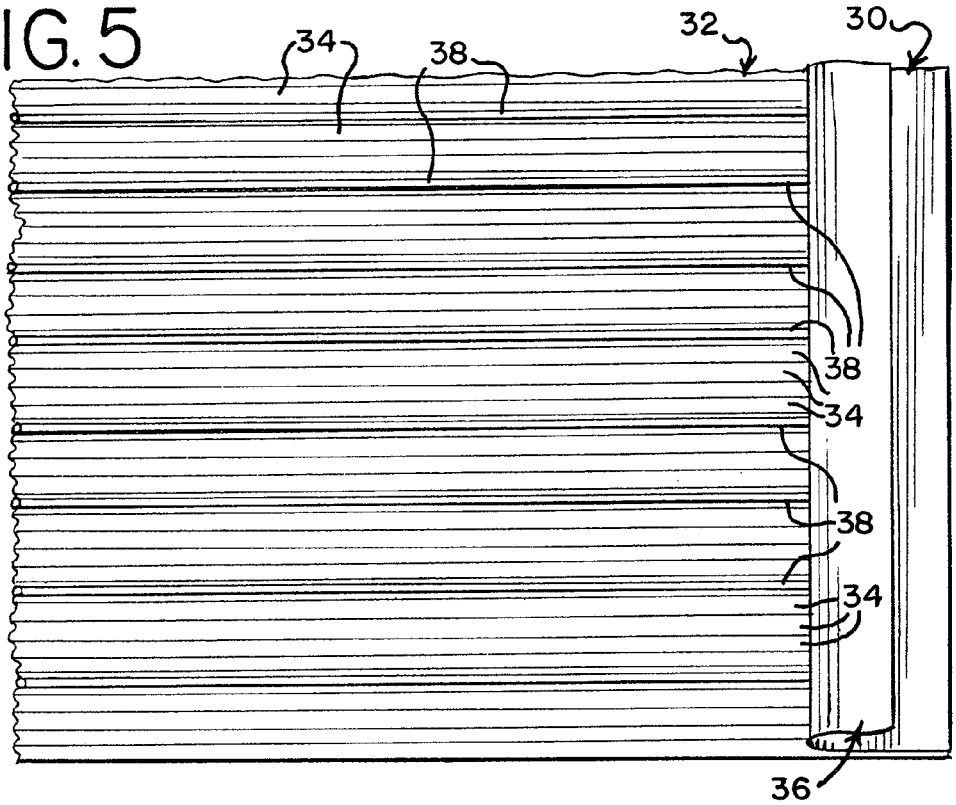
FIG. 5 is a view similar to FIG. 4, showing varying spacing of the rods.
Figure 6:
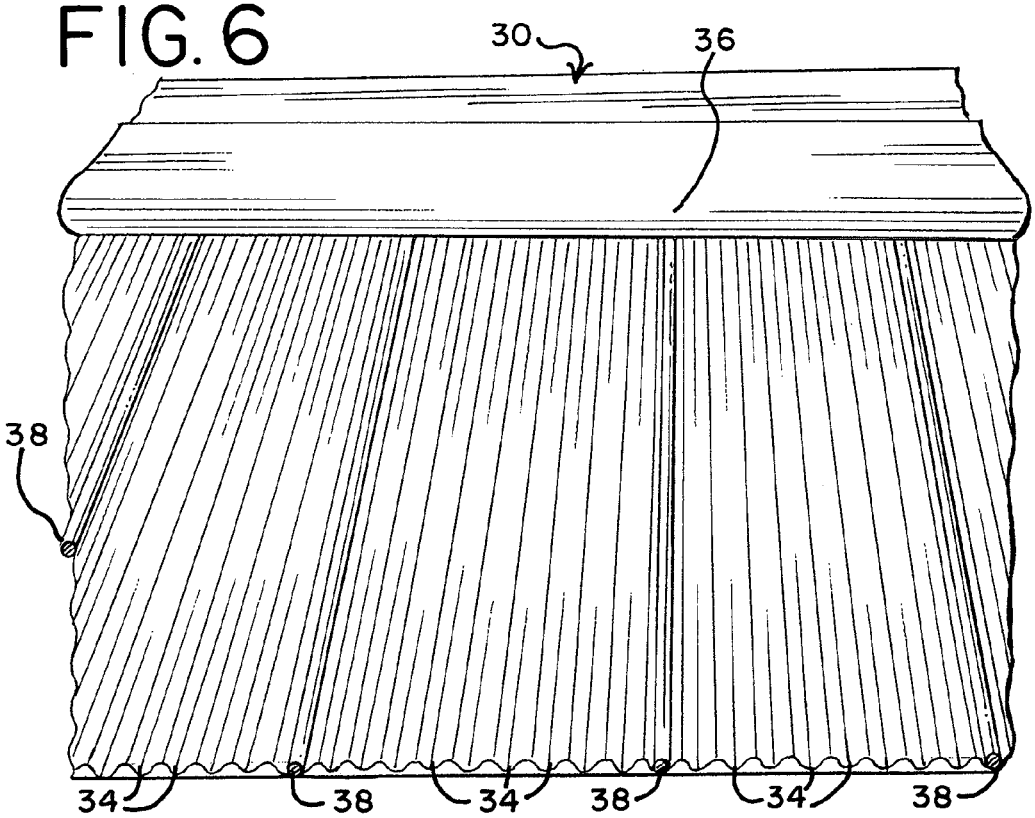
FIG. 6 is a longitudinal view of the foundation deck, showing rods lodged in corrugations of corrugated material forming the variable spring surface deck.

A foundation unit employed as a part of a foundation according to the invention is shown generally at 10 in FIG. 1. While the foundation unit may be configured in many different ways, the foundation unit 10 of FIG. 1 is of determined depth and has a bottom substructure 12, a flat top bearing structure 14, and an intermediate support 16 for maintaining the determined depth of the foundation unit 10.

In the form shown in FIG. 1, the bottom substructure comprises a series of longitudinal slats 18, interconnected as needed for desired rigidity. The top bearing structure 14 includes a series of spaced cross slats 20 extending between longitudinal side rails 22. The intermediate support 16 comprises a plurality of upright blocks 24 extending between the bottom substructure 12 and the top bearing structure 14. What is shown in FIG. 1 is for illustrative purposes, only, and the particular elements of the foundation unit 10 can be conventional and of many different types, such as a full steel-wire foundation unit like that of U.S. Pat. No. 4,377,279, the disclosure of which is incorporated herein by reference.

The variable spring surface deck according to the invention is shown in FIGS. 2 through 6. In this form of the invention, the variable spring surface deck comprises a carrier or mat 30 which may be as simple as a sheet of corrugated cardboard which is cut to size to cover the top of the foundation unit 10. The carrier 30 includes a corrugated sheet 32 which includes spaced, open slots or corrugations 34. A top sheet 36 is shown peeled away in the drawing figures to show detail, and normally would occupy the entire top of the carrier 30.

A plurality of longitudinal, spring wire support rods 38 are maintained in a spaced orientation in a planar configuration in the carrier 30. The spring wire rods 38 are installed, as desired, in the corrugations 34, and can be regularly spaced at desired intervals along the carrier 30. While the rods 38 can be equally spaced, as shown in the drawing figures, the spacing between the rods 38 can vary, as desired, which therefore varies the spring surface of the deck. Preferably, the wire rods, which may extend substantially the length of the carrier 30 and therefore the length on the foundation unit 10, or only desired portions of the length, are laminated in the corrugated sheet 32 and then the carrier 30 is applied to the top of the foundation unit 10.

Preferably the rods are high carbon steel spring wire, which therefore gives the top surface of the foundation unit 10 a high carbon steel wire surface. The carrier 30 can be varied from a minor amount of spring wire support to a major amount of spring wire support by varying the size, density and location of the rods 38. The carrier 30 can be zoned, for example, by adding more support to one area, such as the center third of the carrier 30. A further advantage of the invention is that a standard foundation unit, such as that shown in FIG. 1, can serve as the base for many different quality variations in a product line by simply applying a different variable spring surface deck with rods 38 of a different gauge, placement or density.

In another form of the invention, rather than using the carrier 30 for the rods 38, the rods can be affixed to the top bearing structure 14 or to another sheet of material by any means, such as by gluing, stapling or any other means of not only fixing them in place, but in relation to one another for appropriate spacing and, therefore, resulting strength or zoning of various areas of the top bearing structure of the foundation unit 10.

While preferably the rods 38 are high carbon steel spring wire rods, the rods can be made of other materials exhibiting the same or similar spring and support qualities. Also, while the rods 38 are preferably circular in cross section, they can be square, rectangular, triangular or any other configuration that provides the variable spring surface of the foundation according to the invention.

Figure 7:
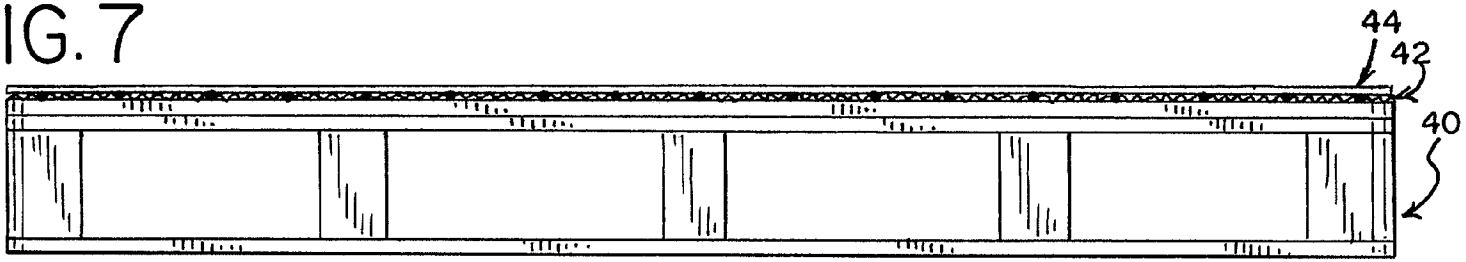
FIG. 7 is an elevational view of another form of the invention, in which the rods are provided in a matrix fashion.
Figure 8:
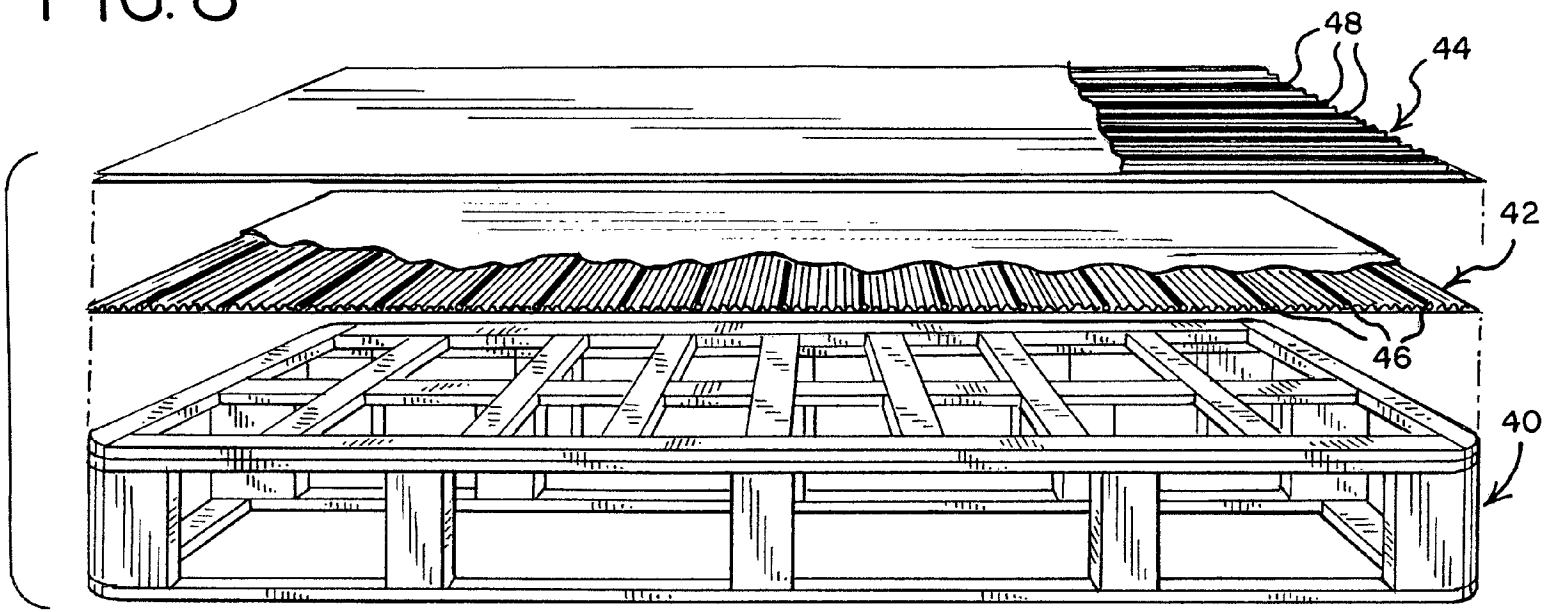
FIG. 8 is an assembly view of the embodiment of the invention shown in FIG. 7.

FIGS. 7 and 8 depict another form of the invention. In this form of the invention, three basic elements are employed, a foundation unit 40, an intermediate carrier 42 and a top carrier 44.

The foundation unit 40 may be identical to the foundation unit 10, or, due to the nature of the carriers 42 and 44, the foundation unit 40 may be the same as the foundation unit 10 expect that the top bearing structure has fewer or none of the cross slats 20.

In this form of the invention, the carrier 42 has a series of lateral spring wire support rods 46. Just as in the earlier forms of the invention, the support rods 46 can be mounted in a corrugated sheet, or can be otherwise affixed to the top of the foundation unit 40. Similarly, the carrier 44 includes a series of spaced, longitudinal spring wire support rods 48. The support rods 48 can be formed and mounted in the same manner as the support rods 46. Thus, when located one atop the other, the crossing support rods 46 and 48 form a matrix or grid surface on the foundation unit 40.

While the support rods 46 and 48 are shown as either lateral or longitudinal, it will be evident that the support rods can be otherwise oriented on the foundation unit 40 so long as they form a matrix of some form, with rods of the two layers crossing one another.

Also, just as in the first form of the invention, the rods 46 and 48 can be located at varying spacings to impart varying stiffness, and, particularly in the upper carrier 44, the rods can be less than full length, to again impart varying stiffness.

Various changes can be made to the invention without departing from the spirit thereof or scope of the following claims.

What is claimed is:

1. A variable spring surface deck for a foundation, comprising a. a plurality of longitudinal spring wire support rods, and b. a carrier enveloping and maintaining said support rods in a spaced orientation in a planar configuration.

2. The variable spring surface deck according to claim 1, in which said carrier comprises a mat having a series of parallel slots, each slot being shaped to engage one of said support rods.

3. The variable spring surface deck according to claim 2, in which said slots are regularly spaced.

4. The variable spring surface deck according to claim 1, in which said support rods are equally spaced.

5. The variable spring surface deck according to claim 1, in which said carrier comprises a corrugated sheet.

6. The variable spring surface deck according to claim 5, in which said sheet includes spaced, open corrugations, said rods being located in at least some of said corrugations.

7. The variable spring surface deck according to claim 1, including a plurality of lateral spring wire support rods in a planar configuration, said longitudinal and lateral spring wire support rods forming a matrix.

8. A variable spring surface foundation, comprising a. a foundation unit of determined depth and having a bottom substructure, a flat top bearing structure generally rectangular in shape and an intermediate support for maintaining said determined depth, and b. a deck on said top bearing structure, said deck comprising i. a plurality of spaced, longitudinal, spring wire support rod, and ii. a carrier enveloping and maintaining said support rods on said top bearing structure.

9. The variable spring surface foundation according to claim 8, in which said carrier comprises a mat having a series of parallel slots, each slot being shaped to engage one of said support rods.

10. The variable spring surface foundation according to claim 9, in which said slots are regularly spaced.

11. The variable spring surface foundation according to claim 8, in which said carrier comprises a corrugated sheet.

12. The variable spring surface foundation according to claim 11, in which said sheet includes spaced, open corrugations, said rods being located in at least some of said corrugations.

13. The variable spring surface foundation according to claim 8, in which said carrier comprises a corrugated cardboard sheet, said rods being located at intervals in corrugations of said sheet.

14. The variable spring surface foundation according to claim 8, including a plurality of lateral spring wire support rods in a planar configuration, said longitudinal and lateral spring wire support rods forming a matrix.

* * * * *